US005136130A

United States Patent [19]

Daly

[11] Patent Number: 5,136,130

[45] Date of Patent: Aug. 4, 1992

[54] LOCKING ACTUATOR TRIGGER BUTTON FOR ELECTRICAL SWITCH

[75] Inventor: Maura A. Daly, Glendale Heights, Ill.

[73] Assignee: Waxing Corporation of America, Orange, Calif.

[21] Appl. No.: 679,680

[22] Filed: Apr. 2, 1991

[51] Int. Cl.[5] ..... H01H 1/52

[52] U.S. Cl. ..... 200/318.1; 200/321

[58] Field of Search ..... 200/522, 318.1, 321, 200/322, 323, 43.16, 43.17, 43.18, 573, 330, 331

[56] References Cited

U.S. PATENT DOCUMENTS

| | | | |
|---|---|---|---|
| 3,185,783 | 5/1965 | Dowdle et al. | 200/330 |
| 3,309,484 | 3/1967 | Frenzel | 200/157 |
| 3,378,662 | 4/1968 | Sorenson | 200/157 |
| 3,662,136 | 5/1972 | Bienwald et al. | 200/157 |
| 3,781,579 | 12/1973 | Rosenthal, Jr. et al. | 310/68 A |
| 3,869,591 | 3/1975 | Piber | 200/321 |
| 3,953,696 | 4/1976 | Reimann et al. | 200/157 |
| 4,044,215 | 8/1977 | Leibinger et al. | 200/321 |
| 4,188,682 | 2/1980 | Burglin et al. | 15/97 R |
| 4,241,298 | 12/1980 | Trammell, Jr. et al. | 200/522 |
| 4,480,163 | 10/1984 | Morris et al. | 200/331 |
| 4,954,668 | 9/1990 | Sako | 200/331 |
| 4,994,636 | 2/1991 | Wang | 200/321 |

FOREIGN PATENT DOCUMENTS

| | | | |
|---|---|---|---|
| L17151 | 7/1956 | Fed. Rep. of Germany . | |
| 1947014 | 3/1971 | Fed. Rep. of Germany | 200/321 |
| 2348668 | 3/1975 | Fed. Rep. of Germany . | |
| 147622 | 11/1962 | U.S.S.R. . | |

*Primary Examiner*—Henry J. Recla
*Assistant Examiner*—David J. Walczak
*Attorney, Agent, or Firm*—Fitch, Even, Tabin & Flannery

[57] ABSTRACT

A locking switch apparatus for an electric device inlcudes a trigger button having a pair of spaced flanges cooperating to define a switch-receiving cavity. An electrical switch has a hollow dielectric body with opposed sidewall and bottom surfaces. A lock member has a base and a pair of upstanding posts also forming a switch-receiving cavity. The switch is secured in a stationary position with the locking member and trigger button disposed about the switch for camming action therewith, which includes an unlocked position with the switch de-energized, and an innerlocked position where the switch is constantly energized. By depressing the trigger button, the lock mechanism is free to disengage under the force of a return spring.

20 Claims, 3 Drawing Sheets

LOCKING ACTUATOR TRIGGER BUTTON FOR ELECTRICAL SWITCH

BACKGROUND OF THE INVENTION

1. Field of the Invention

The present invention pertains to switches for electrical appliances and in particular to operating mechanisms for such switches having the ability to lock in a constant energized mode.

2. Description of the Related Art

Electrical appliances, especially appliances having electric motors have been provided with push buttons to switch the motor on and off as desired. Electric power tools, for example, are sometimes used for long periods of time and it is desirable to provide an electric switch which need not be constantly pressed to switch the motor on. Accordingly, a variety of arrangements have been provided to lock a push button electrical switch in an operating position. Such arrangements are alternatives to so-called "rocker" switches or "toggle" switches which incorporate mechanical mechanism having a bistable mode of operation.

Russian Patent No. 147,622 and Offenlegungsschrift No. 23 48 668 have switch operators with a window for receiving a stepped push button. The button can be operated so as to bring different stepped portions into engagement with the actuator window, thus providing different modes of operation. For example, the actuator window can be selectively held in a first position in which the electrical switch is turned on.

U.S. Letters Pat. No. 3,378,662 provides a trigger button having an internal saw tooth edge. A separate locking button has an enlarged free end which engages the teeth of the push button arrangement, thus locking the push button at a desired depressed condition. The locking button is spring-loaded so that, with increased pressure applied to the trigger button, the lock button will be released, thereby allowing the trigger button to move to an undepressed position. Thus, the trigger button can be moved to a number of depressed positions, corresponding to the number of teeth internal to the button mechanism.

U.S. Letters Pat. No. 3,309,484 provides a simpler locking mechanism for a trigger button which has an aperture formed in the button actuator. A trigger button is located along the path of travel of the trigger button, and is extendable into the path of the trigger button so as to be received in the trigger button aperture, thus locking the trigger button in a depressed position. Both the trigger button and the locking button are spring loaded to facilitate release of the trigger to an undepressed position. Locking arrangements which interfere or interlock with a trigger button are also disclosed in U.S. Letters Pat. Nos. 3,662,136; 3,869,591, and 3,953,696.

U.S. Letters Pat. No. 3,781,579 provides a sliding lock which interferes with the movement of a trigger button. The sliding lock operates an intermediate plunger member which in turn interferes with the trigger button, maintaining the button in a depressed position.

German Patent No. DTL 017151 discloses a locking electrical switch having a trigger button with a recess on one edge, and a slotted tail member for engaging the arm of a spring loaded electrical contact. The trigger button is spring loaded with a separate spring member. A crank arm is pivotally mounted in the switch mechanism, adjacent the trigger button and includes a pawl tooth to be received in the recess of the trigger button. The crank arm is spring biased to a position for engagement with the trigger button, using a separate spring member. A lock button is engageable with the crank arm to move the pawl tooth out of engagement with the trigger button, thus freeing the trigger button for movement to an undepressed position.

The above switch mechanisms are relatively complicated to fabricate and install in an electrical appliance. Further, when a molded housing is employed with the electrical appliance, the housing design is complicated as the number of switch components is increased, thus complicating the mold design and further adding to the cost of the appliance.

It is desirable to provide a push button lock having momentary operating positions in addition to a selectable locking arrangement for moving the switch between two or more stable operating positions. However, to be economically attractive to an appliance manufacturer, such arrangements should have fewer moving parts which are inexpensively formed using conventional materials. Double insulated tools, for example, are frequently made with molded plastic housings and it is advantageous to provide switch mechanisms having molded plastic parts. Further, it is desirable to provide a switch mechanism with moving parts which are less delicate, and which will provide reliable operation over the life of the electrical appliance.

Further, it is desirable in some situations to employ a commercially available electrical switch component such as a miniature switch having a hollow plastic housing and an actuator stub shaft protruding from a surface of the housing.

SUMMARY OF THE INVENTION

It is an object of the present invention to provide an actuator mechanism for an electrical switch component of the type having a hollow plastic body with an actuator stub shaft protruding through a surface of the housing.

Another object according to the present invention is to provide a mounting for a switch component of the above type and for arranging switch actuator parts about the switch component, and in particular, switch actuator parts which register on the body of the switch component.

Another object according to the present invention is to provide a switch actuator mechanism of the above-described type which locks the switch component at a stable position to energize the electrical appliance.

Yet another object of the present invention is to provide a switch actuator mechanism which relies on the spring force of the switch components, thus eliminating the need for a separate return spring for the trigger button.

These and other objects according to the present invention, which can be seen from the following description and drawings are provided in a locking switch apparatus for an electric device, comprising:

a trigger button having a manually engageable operating portion and a pair of spaced apart downwardly extending flanges cooperating with the operating portion to define a switch-receiving cavity, said trigger button movable between first and second positions;

an electrical switch device adjacent the trigger button and having a hollow body with a first surface and an actuator member extending from the first surface toward the operating portion of the trigger button so as to be engaged by the trigger button when the trigger button is moved between the first and second positions;

a lock member movable in opposite directions between locked and unlocked positions, having a slide rail extending in the direction of movement and at least one locking tooth carried on the slide rail for engagement with said trigger button flange when said lock member is moved to said locked position;

return bias means for biasing said lock member to said unlocked position; and said trigger button being movable out of engagement with said locking tooth when said lock member is moved to said unlocked position.

BRIEF DESCRIPTION OF THE DRAWINGS

In the drawings, wherein like elements are referenced alike.

DETAILED DESCRIPTION OF THE PREFERRED EMBODIMENT

Figure 1:
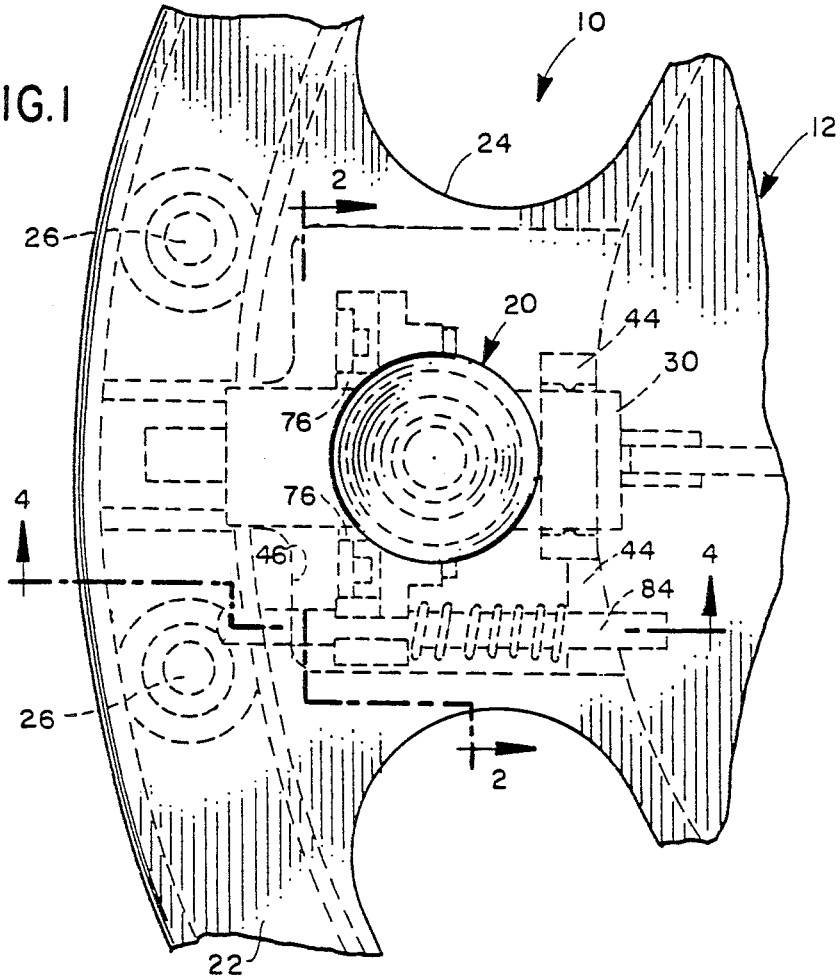
FIG. 1 is a fragmentary plan view of an electrical appliance with a switch apparatus according to principles of the present invention.
Figure 2:
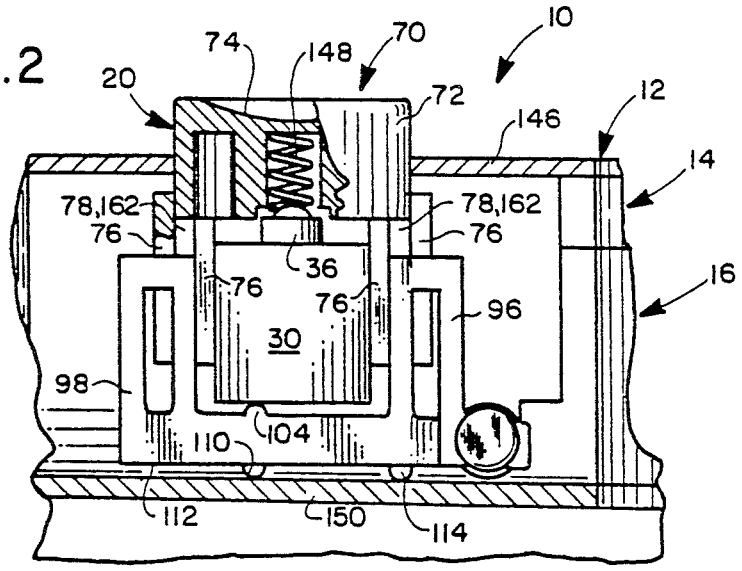
FIG. 2 is a fragmentary elevational view, shown partly broken away, taken along the lines 2—2 of FIG. 1.

Referring now to the drawings, and initially to FIG. 1, an electrical appliance generally indicated 10 has a molded plastic housing generally indicated at 12, including upper and lower housing parts 14, 16 (see FIG. 2). Disposed within housing 12 is a locking switch apparatus generally indicated at 20. Appliance 10 comprises an automobile cleaning and waxing tool of the type described in commonly assigned U.S. Letters Pat. No. 4,188,682 which is herein incorporated by reference, but the present invention can be used with other types of electrical appliances as well. The housing 12 includes a thin wall handle ring 22 connected to the central portion of the housing by hollow spoke formations 24. As will be seen herein, the locking switch apparatus is conveniently located in one hollow spoke formation, as illustrated in FIG. 1. The upper and lower housing portions 14, 16 are secured together by bosses 26 which receive threaded fasteners.

Figure 3:
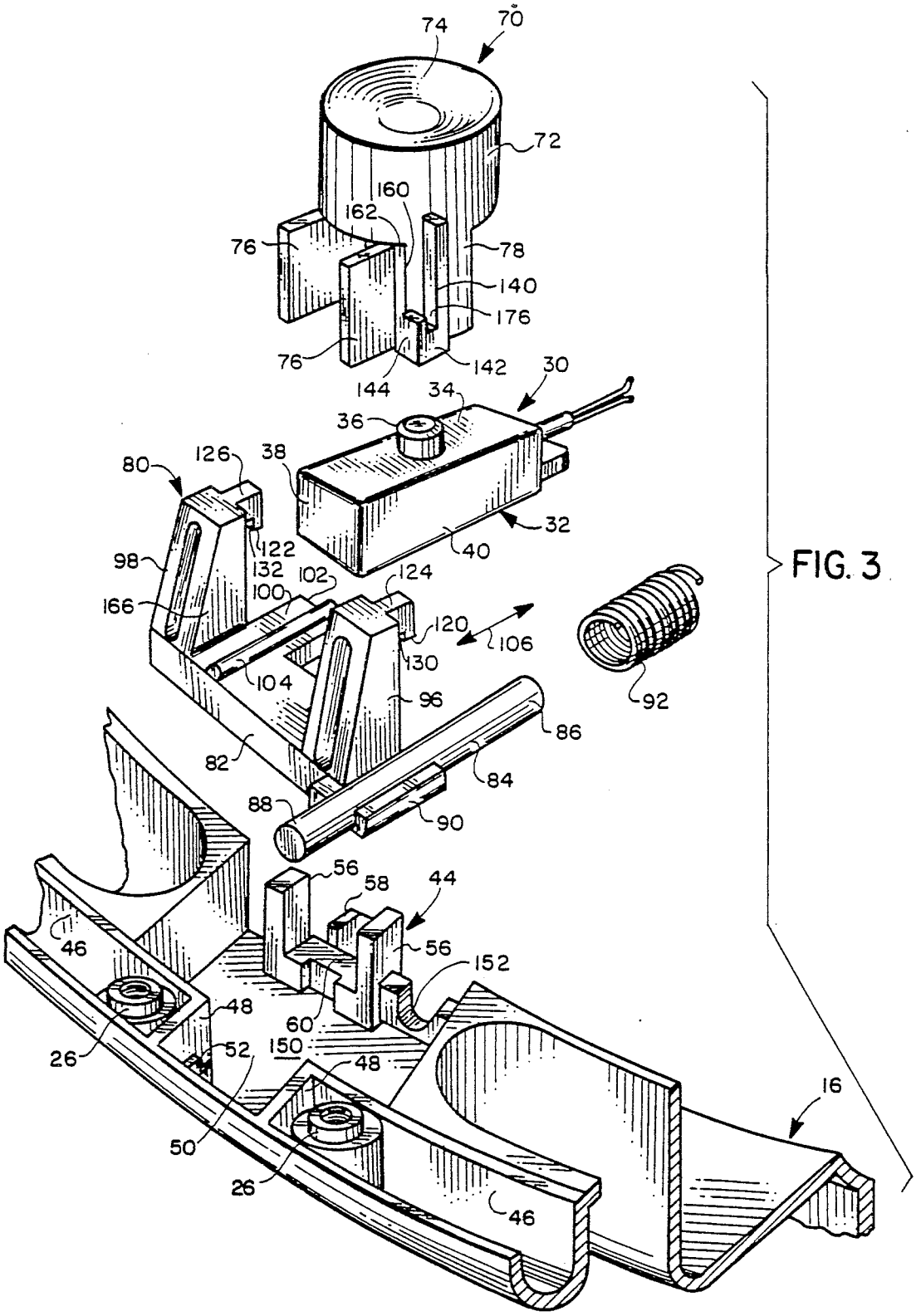
FIG. 3 is an exploded perspective view of the switch apparatus according to the present invention.

Referring additionally to FIGS. 2 and 3, a conventional switch component 30 has a hollow plastic body 32 within which electrical contacts and spring bias means are located. Switch body 32 has an upper surface 34 through which an actuator stub shaft 36 extends. The stub shaft 36 communicates with contacts within switch body 32 and is spring biased to the extended position illustrated in FIGS. 2 and 3. The switch body 32 has an elongated, rectangular configuration with endwalls 38 and sidewalls 40 (see FIG. 3).

The lower housing part 16 is preferably formed of molded plastic and has a number of internal features, including an inner wall generally indicated at 44, and outer walls 46 having a pair of opposed wall portions 48. A pocket 50 is formed between inner and outer walls 44, 46 for receiving the switch component 30. Steps 52 are provided on opposed walls 48 for receiving one end of switch body 32. Inner wall 44 includes a pair of upstanding posts 56 for engaging sidewalls 40 of the switch body. A fin member 58 engages one end wall 38 of the switch body to provide orientation in a horizontal plane. The steps 52 and the bottom surface 60 of the inner wall provide alignment of the switch body in vertical directions, the switch body being bottomed against steps 52 and surface 60, so as to be pressed in the pocket 50 with a closely dimensioned interference fit. Thus, the switch component 30 is firmly mounted within housing part 16, being secured for a desired three dimensional orientation. As will be seen herein, such orientation of the switch body is important, in part, to provide guide surfaces for registering or aligning the switch actuating parts which include a movable trigger button generally indicated at 70 and a movable lock member generally indicated at 80.

The trigger button 70 includes an upper manually engageable portion 72, which is generally cylindrical in configuration and which has a concave upper end 74, which extends above housing 12 for ready manual engagement by a user of the appliance. Trigger button 70 further includes a pair of spaced apart flanges 76 which cooperate with the upper portion 72 of the button to form a cavity for receiving the switch component 30, as can be seen in FIG. 2. Sidewalls 78 are provided adjacent each flange 76, and a locking tooth and a plurality of ribs are provided on each sidewall for locking engagement as will be described herein.

The lock mechanism 80 has a base 82 extending at a generally right angle to a slide rail 84 having a forward free end 86 and a rearward free end 88. The lock member 80 is preferably formed of monolithic molded elastic material with slide rail 84 extending from one end of base 82. An ear 90 extends from the outside of slide rail 84 to provide a stop for return spring 92, which is telescopically received on slide shaft 84. Posts 96, 98 extend above base 82, with post 96 being positioned adjacent slide rail 84 and post 98 being positioned at the free end of base 82. A stub portion 100 extends from base 82, in a direction generally parallel to slide rail 84. The stub 100 has a free end 102. A rib 104 protrudes above the stub to provide a low friction slide surface as lock member 80 is reciprocated thereacross in the direction of arrow 106. A rib 110, substantially identical to rib 104 extends from the bottom surface 112 of base 82 (see FIG. 2). A rib 114 is positioned beneath post 96 and also extends from bottom surface 112 of the lock base.

Figure 4:
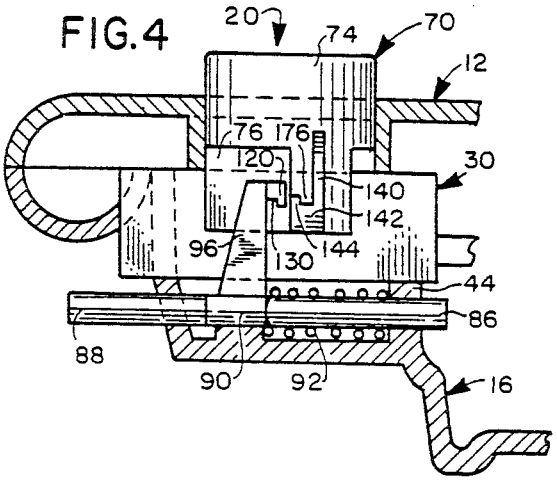
FIGS. 4–9 show the switch apparatus at various points in an operating cycle.

Referring again to FIG. 3, lock teeth 120, 122 extend from posts 96, 98 being joined to the posts by standoff portions 124, 126, respectively. As can be seen in FIG. 4, for example, the locking teeth are spaced from the forward edges of the posts, so as to form a cavity, such as the cavity 130, visible in FIG. 4. A similar cavity 132 is formed by post 98 and lock tooth 122, as can be seen in FIG. 3.

Referring now to FIGS. 3 and 4, the trigger button has a series of ribs on each sidewall. For example, sidewall 78 visible in FIG. 3 has ribs 140, 142 and rib-like locking tooth 144 joined end-to-end to form a J-shaped configuration. A mirror image arrangement of the ribs and locking tooth is provided on the other sidewall 76.

Referring now to FIGS. 1–4, the lock member 80 is seated in pocket 50, with ribs 110, 114 contacting floor member 150 and with a forward end 86 of slide rail 84 received in recess 152 formed in inner wall 44. The free end 88 of slide rail 84 protrudes through an aperture in outside wall 46, located adjacent the right hand boss 26 of FIG. 3. Return spring 92, inserted over slide rail 84 is held captive between ear 90 of the lock member and inner wall 44. As mentioned, slide rail 84 is received in recess 152 in an aperture in outer wall 46, but is otherwise unrestrained in its ability to move within pocket 50.

The switch component 30 is then installed in pocket 50, with a close tolerance interference fit with the inner wall 44, and with steps 52 formed in the outer wall of lower housing part 16. As mentioned, when switch component 30 is installed in pocket 50, it is fixed against movement of any kind, a feature which provides reference guide surfaces for the trigger button and lock member. Next, the trigger button 70 is installed so that the flanges 76 straddle the sides 40 of the switch body 32. As mentioned, the switch body 32 is of generally rectangular configuration and has flat sidewalls 40 against which flanges 76 may slide.

As indicated in FIG. 2, the spacing between flanges 76 provides a close tolerance engagement with the sidewalls of the switch body. As can be seen in FIG. 3, the flanges 76 extend beyond the profile of the upper cylindrical portion of trigger button 70 and help stabilize the trigger button as it moves in vertical directions. The upper housing portion 14 is then secured to lower portion 16 in the manner indicated in FIG. 2 to complete assembly of the appliance. The upper housing portion 14 has a circular opening in the upper wall 146 and provides additional guiding of trigger button 70. As can be seen in FIG. 2, a central cavity is provided in trigger button 70 so as to house extension spring 148, aligning the spring 148 in registry with stub shaft 36. The extension spring 148 is provided so that the movement of the trigger button, beyond a point where the electrical switch component is operated, can be increased without damage to the switch.

Figure 6:
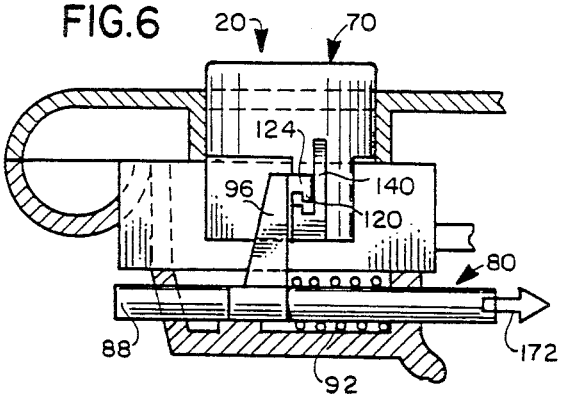
Figure 7:
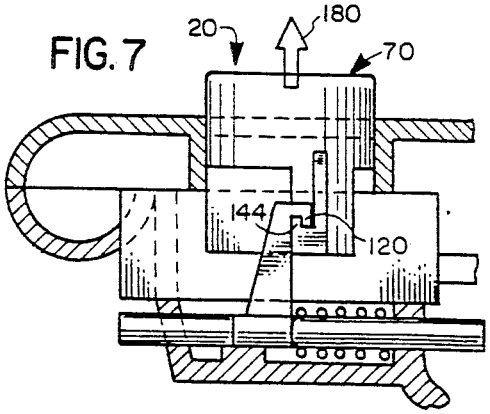
Figure 8:
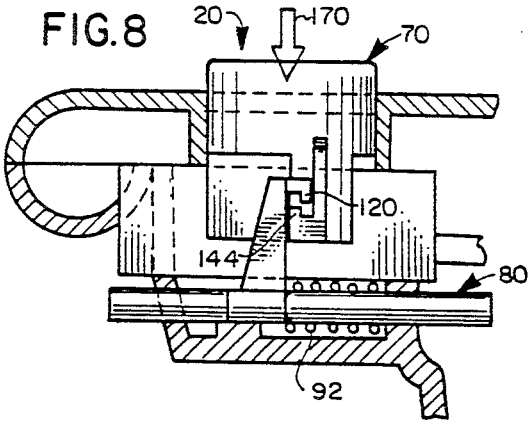

Referring again to FIG. 3, the stand-off portions 124, 126 are narrower than the upper ends of posts 96, 98, thus forming a pair of laterally opposed vertical channels which are L-shaped in cross-section. Referring to post 96, for example, these channels receive the stepped portion 160 of the trigger button, formed at the joinder of edge 62 of sidewall 78 and flange 76. This interengagement of the L-shaped channels with the trigger button sidewall occurs during that portion of the operating cycle illustrated in FIGS. 6–8 when the lock member is depressed. At this same point in the switch operation, the forward vertical surfaces of the lock teeth 120, 122 engage the upright ribs 140 as can be seen in FIGS. 6–8.

In addition, the flanges 76 bear against the opposing trapezoidal surfaces 166 of posts 96, 98 (see FIG. 3). Prior to the depression of lock member 80, the posts 96, 98 are aligned by the contact of flanges 76 with post surfaces 166, and as can be seen in FIG. 2, the lock member 80 is further confined by contact of rib 104 with the stationary switch component 30 and by contact of ribs 110, 114 with the floor 150 of housing part 16.

Referring now to FIGS. 4–9, operation of the switch apparatus will now be described. FIG. 4 shows the switch apparatus at rest in a de-energized, "off" position. The trigger button 70 is in a raised position, but contact with stub shaft 36 of the switch component 30 is maintained by spring 148. With downward pressure applied to the trigger button 70, in the direction of arrow 170 (see FIG. 5) spring 148 is compressed until the spring force is sufficient to overcome the spring internal to the switch component 30, thus resulting in depression of stub shaft 36 and resulting operation of the switch. In the preferred embodiment, the switch is operated with just a slight depression of trigger button 70 from the position illustrated in FIG. 4. If desired, the switch mechanism can be operated in a momentary fashion, without locking the switch mechanism for constant energizing of the appliance.

Figure 5:
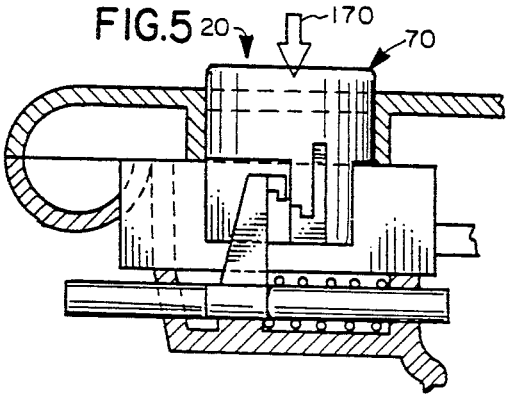

When locking of the switch is desired, the push button 70 is depressed an additional amount, as illustrated in FIG. 5 to prepare the mechanism for a locking operation. Referring to FIG. 6, the manually engageable end 88 of lock mechanism 80 is advanced toward the interior of appliance 10, in the direction of arrow 172. As mentioned, the manually engageable end 88 of slide rail 84 protrudes beyond the outer wall of the appliance housing so as to be easily accessible to a user. The lock mechanism 80 is advanced in the direction of arrow 172 until the end 102 of stub 100 contacts inner wall 44, thus aligning the locking structures on the push button and lock mechanism as illustrated in FIG. 6. As indicated in FIG. 6, the locking tooth 120 of lock mechanism 80 is aligned with the cavity 176 formed between rib 140 and tooth 144 of trigger button 70. At the same time, the tooth 144 on the trigger button is aligned with cavity 130 formed on the lock mechanism. Thus, teeth on both the trigger button and lock mechanism are aligned for reception in corresponding cavities and with release of pressure on trigger button 70, the trigger button is allowed to travel in the upward direction of arrow 180 as illustrated in FIG. 7.

Figure 9:
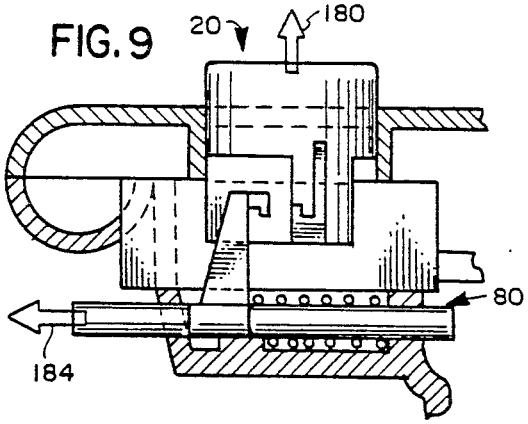

When advanced in the direction of arrow 172, the slide rail 80 compresses return spring 92, thus storing energy in the spring for a switch release operation and to maintain the locking teeth 120, 144 in the locked position illustrated in FIG. 7. In the preferred embodiment, the electrical appliance 10 is energized for an indefinite operating period when switch apparatus 20 is locked in the position illustrated in FIG. 7. When it is desired to discontinue operation of the appliance, the trigger button 70 is depressed as indicated by arrow 170 in FIG. 8 to bring the locking tooth 144 out of engagement with the locking tooth 120 of lock mechanism 80. As mentioned, spring energy is stored in return spring 92 and friction created by the return spring must be overcome, in addition to the spring force internal to switch component 30, and the optional spring 148 of trigger button 70. Such forces are of course easily overcome with slight manual pressure on trigger button 70. With clearance of tooth 144 below tooth 120, the spring 92 is free to resume its extended position as illustrated in FIG. 9, advancing the lock mechanism in the direction of arrow 184 until ear 90 contacts the outer wall of housing 16. At the same time, the spring internal to switch component 30 advances stub shaft 36 and trigger button 70 in the upward direction of arrow 180, returning the trigger button to its relaxed position, ready for a subsequent operating cycle.

As can be seen in FIGS. 6–8, the rib 140 carried on trigger button 70 provides a guide surface for stand-off 124 and tooth 120 to provide a camming action during the operating cycle when both the trigger button 70 and locking mechanism 80 are simultaneously depressed. At this same time, the post 96 provides a guide surface against which tooth 144 is cammed. As mentioned above, additional guiding of the moving parts is provided by the camming engagement by the stepped surfaces 160, 162 of sidewall 78 with the opposed vertical faces of the stand-offs and locking teeth of mechanism 80. Further, the flanges 76 slide or cam against the opposed faces 166 of posts 96, 98. Flanges 76 cam against the opposed sidewalls 40 of switch component 30, while rib 104 cams against the bottom surface of the switch component. Use of the switch component surfaces for camming insures a continuous, accurate alignment with the stub shaft 36 of the switch component further contributing to the ease and reliability of operation.

There is redundancy in the number of sliding or camming surfaces provided on trigger button 70 and lock mechanism 80 to assist in guiding those members between the fully locked position of FIG. 7 and the fully unlocked position of FIG. 9. If desired, the dimensions and tolerances of trigger button and locking mechanism surfaces can be relaxed if this redundancy of camming surfaces is not required or if it is desired to reduce the number of camming surfaces on either part, to simplify their configuration. However, this is not preferred, since the large number of sliding or camming surfaces reduces the risk of jamming and insures smooth, trouble-free operation throughout the lift of appliance. Thus, in the preferred embodiment, the surfaces of the switch component are relied upon to enhance the smooth sliding action of the locking switch components without further complicating the configuration or assembly required to install those switch components in the electrical appliance. As a result, the locking switch apparatus is of a minimum mass and has an "open" construction without requiring continuous guide walls in the housing for either the trigger button or lock mechanism components.

As can now be seen, the various components of the locking switch apparatus may be conveniently formed of molded plastic or other dielectric materials. Such construction provides economies of manufacture, without compromising the electrical insulation characteristics of the appliance. As will be appreciated from the above description of the assembly process of the appliance, the number of steps and complexity of the locking switch apparatus assembly is significantly reduced, further contributing to the overall economy of manufacture of the appliance.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following Claims.

What is claimed is:

1. Locking switch apparatus for an electric device, comprising:

a housing;

a push button having a manually engageable operation portion slidable in said housing from a first to a second position and a pair of spaced apart parallel flanges connected to the operation portion and extending in the direction of movement of the operating portion so as to be define a switch-receiving cavity, said push button movable therewith between said first and second positions and further having a locking tooth carried on one of said flanges;

an electrical switch device positioned between said flanges and having a hollow body with a first surface and an actuator member extending from the first surface toward the operating portion of the push button so as to be engaged by the push button when the push button is moved between the first and second positions;

a lock member slidably mounted in said housing in a direction normal to said direction of movement of said push button and movable in opposite directions between locked and unlocked positions, said lock member having a slide rail extending in the direction of movement of said lock member, a base extending from the slide rail and at least one post extending from the base in a side by side relation with at least one of said flanges, and at least one locking tooth carried on the post which engages with the locking tooth carried on said one flange of said push button when said lock member is moved to said locked position;

return bias means for biasing said lock member to said unlocked position; and said locking tooth carried on said post being movable out of engagement with said locking tooth carried on said flange of said push button when said lock member is moved to said unlocked position.

2. The apparatus of claim 1 wherein said lock member further comprises a standoff portion between said locking tooth and said post and cooperates with said locking tooth and said post to define a tooth-receiving cavity for receiving the locking tooth carried on said one push button flange.

3. The apparatus of claim 2, wherein said push button further comprises a plurality of rib members carried on said flange, and cooperating with the tooth on said push button to form a tooth-receiving cavity for receiving the locking tooth carried on said lock member.

4. The apparatus of claim 2 wherein said lock member further comprises a second post extending from the base, and a second locking tooth carried on said second post and separated therefrom by a second standoff portion so as to define a second tooth-receiving cavity, and said push button further comprises a second locking tooth carried on the other of said push button flanges so as to be received in said second tooth-receiving cavity.

5. The apparatus of claim 4 wherein said posts and said base form a cavity for receiving said electrical switch device, said posts being spaced for engagement with said push button flanges, with said electrical switch device between said flanges to maintain the spacing of said flanges.

6. The apparatus of claim 4 wherein said switch body further comprises a pair of sidewalls and said push button flanges are spaced apart for a close fit engagement with said switch sidewalls so as to be guided thereby as said push button is moved relative to said switch.

7. The apparatus of claim 2 wherein said lock member further comprises a stub member extending from the base to provide a reference stop surface to align the lock member and push button teeth when the lock member is moved to its locked position.

8. The apparatus of claim 1 wherein said electrical switch device includes bias means for biasing said actuator member toward the push button.

9. Electrical apparatus comprising:

a housing of dielectric material including internal wall means defining a pocket for close fit engagement with an outer body of an electrical switch device so as to hold the switch device in a fixed position;

a push button having a manually engageable operating portion slidable in said housing from a first to a second position and a pair of spaced apart parallel flanges connected to the operating portion and extending in the direction of movement of the operating portion so as to define a switch-receiving cavity, said push button mounted in said housing so as to be movable between first and second positions and further having a locking tooth carried on one of said flanges;

an electrical switch device mounted in the housing pocket positioned between said flanges and having a hollow body with a first surface and an actuator member extending from the first surface toward the operating portion of the push button so as to be engaged by the push button when the push button is moved between the first and second positions, the switch device body further having bias means for biasing said actuator member toward the push button body and sidewalls for engaging the internal wall means of the housing;

a lock member mounted in said housing adjacent said pocket so as to be slidable in a direction normal to said direction of movement of said push button and movable in opposite directions between locked and unlocked positions, said locking member having a slide rail extending in the direction of movement of said lock member, a post extending from said slide rail and at least one locking tooth carried on the post which engages with the locking tooth carried on said one flange of said push button when said lock member is moved to said locked position;

return bias means for biasing said lock member to said unlocked position; and said locking tooth carried on said post being movable out of engagement with said locking tooth carried on said flange of said push button when said lock member is moved to said unlocked position.

10. The apparatus of claim 9 wherein said lock member further comprises a base extending from the slide rail with said post extending from the base, and said locking tooth is carried by said post.

11. The apparatus of claim 10 wherein said lock member further comprises a standoff portion between said locking tooth and said post and cooperates with said locking tooth and said post to define a tooth-receiving cavity for receiving the locking tooth carried on said one push button flange.

12. The apparatus of claim 11 wherein said push button further comprises a plurality of rib members carried on said flange, and cooperating with the tooth on said push button to form a tooth-receiving cavity for receiving the locking tooth carried on said lock member.

13. The apparatus of claim 11 wherein said lock member further comprises a second post extending from the base, and a second locking tooth carried on said second post and separated therefrom by a second standoff portion so as to define a second tooth-receiving cavity, and said push button further comprises a second locking tooth carried on the other of said push button flanges so as to be received in said second tooth-receiving cavity.

14. The apparatus of claim 13 wherein:

said posts and said base form a cavity for receiving said electrical switch device, said posts being spaced for engagement with said push button flanges, with said electrical switch device between said flanges to maintain the spacing of said flanges; and said switch body further comprises a pair of sidewalls and said push button flanges are spaced apart for a close fit engagement with said switch sidewalls so as to be guided thereby as said push button is moved relative to said switch.

15. The apparatus of claim 11 wherein said lock member further comprises a stub member extending from the base to provide a reference stop surface to align the lock member and push button teeth when the lock member is moved to its locked position.

16. The apparatus of claim 1 further comprising return spring means for biasing said lock member to its unlocked position.

17. Locking actuator apparatus for an electric switch device having a hollow body with a first surface and an actuator member extending from the first surface toward a push button, and a pair of spaced, generally parallel walls extending from the first surface, comprising:

a housing;

said push button movable between first and second positions and having a manually engageable operating portion slidable in said housing from said first to said second position and a pair of spaced apart parallel flanges connected to the operating portion and extending in the direction of movement of the operating portion so as to define a switch-receiving cavity, and a locking tooth carried on one of said flanges;

a lock member slidably mounted in said housing in a direction normal to said direction of movement of said push button and movable in opposite directions between locked and unlocked positions, said lock member having a slide rail extending in the direction of movement of said lock means, said lock member further comprising a base extending from the slide rail with first and second posts extending from the base, and at least one locking tooth carried on one of said posts which engages with said locking tooth carried on one of said push button flanges when said lock member is moved to said locked position, said posts and said base forming a cavity for receiving said electrical switch device, with said posts being spaced for engagement with said push button flanges; and said locking tooth carried on said post being movable out of engagement with said locking tooth carried on said flange of said push button when said lock member is moved to said unlocked position.

18. The apparatus of claim 17 wherein said lock member further comprises a standoff portion between said locking tooth and said post, which cooperates with said locking tooth and said post to define a tooth-receiving cavity for receiving the locking tooth carried on said one push button flange and said push button further comprises a plurality of rib members carried on said flange, and cooperating with the tooth on said push button to form a tooth-receiving cavity for receiving the locking tooth carried on said lock member.

19. The apparatus of claim 18 wherein said lock member further comprises a second locking tooth carried on said second post and separated therefrom by a second standoff portion so as to define a second tooth-receiving cavity, and said push button further comprises a second locking tooth carried on the other of said push button flanges so as to be received in said second tooth-receiving cavity.

20. The apparatus of claim 17 wherein said lock member further comprises a stub member extending from the base to provide a reference stop surface to align the lock member and push button teeth when the lock member is moved to its locked position.

* * * * *

UNITED STATES PATENT AND TRADEMARK OFFICE

CERTIFICATE OF CORRECTION

PATENT NO. : 5,136,130

DATED : August 4, 1992

INVENTOR(S) : Daly

It is certified that error appears in the above-identified patent and that said Letters Patent is hereby corrected as shown below:

IN THE ABSTRACT:

In the abstract, lines 1-2, change "inl-cudes" to --includes--.

In the abstract, line 11, change "innerlocked" to --interlocked--.

In column 3, line 34, after "indicated" insert --at--.

In column 4, line 32, change "elastic" to --plastic--.

In column 5, line 42, change "62" to --162--.

In column 6, line 48, change "!44" to --144--.

In column 7, line 21, change "lift" to --life--.

In column 7, lines 57-58, change "operation" to --operating--.

In column 7, line 60, change "operation" to --operating--.

In column 7, line 62, after "to" delete "be".

UNITED STATES PATENT AND TRADEMARK OFFICE

CERTIFICATE OF CORRECTION

PATENT NO. : 5,136,130 Page 2 of 2

DATED : August 4, 1992

INVENTOR(S) : Daly

It is certified that error appears in the above-identified patent and that said Letters Patent is hereby corrected as shown below:

In column 10, line 31, change "means" to --member--.

Signed and Sealed this

Twelfth Day of October, 1993

*Attest:*

*Attesting Officer*

BRUCE LEHMAN

*Commissioner of Patents and Trademarks*